US009206533B2

(12) United States Patent
Nägeli et al.

(10) Patent No.: US 9,206,533 B2
(45) Date of Patent: Dec. 8, 2015

(54) CLEARER ROLLER HOLDER FOR A TEXTILE MACHINE

(71) Applicant: Maschinenfabrik Rieter AG, Winterthur (CH)

(72) Inventors: Robert Nägeli, Kleinandelfingen (CH); Ludek Malina, Kloten (CH); Gabriel Schneider, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 14/220,200

(22) Filed: Mar. 20, 2014

(65) Prior Publication Data

US 2014/0317878 A1 Oct. 30, 2014

(51) Int. Cl.
*D01H 5/62* (2006.01)
*D01H 5/64* (2006.01)

(52) U.S. Cl.
CPC ... *D01H 5/62* (2013.01); *D01H 5/64* (2013.01)

(58) Field of Classification Search
CPC ..... D01H 5/64; D01H 5/62
See application file for complete search history.

(56) References Cited

U.S. PATENT DOCUMENTS

| | | | | |
|---|---|---|---|---|
| 2,730,770 | A | 1/1956 | Higginbotham et al. | |
| 4,922,705 | A * | 5/1990 | Sakai et al. | 57/306 |
| 2006/0150374 | A1 * | 7/2006 | Pape | 19/236 |

FOREIGN PATENT DOCUMENTS

| | | | |
|---|---|---|---|
| DE | 1 833 936 | | 6/1961 |
| GB | 981573 | * | 7/1962 |

* cited by examiner

*Primary Examiner* — Randall Chin
(74) *Attorney, Agent, or Firm* — Dority & Manning, P.A.

(57) ABSTRACT

A device is provided for cleaning roller surfaces of rollers that are arranged one behind the other at a radial distance (b) from one another for processing fiber material (F) on a textile machine. A clearer roller is received in a guide of a clearer roller holder, wherein the guide is acted on by a spring element, and the clearer roller is pressed via a pressing force (AK) against the roller surfaces of the adjacent rollers. In order that by swiveling a top roller support arm upwards, the clearer roller is lifted off the roller surfaces to be cleaned and is able to adapt to different diameter ratios ($D_b/D_a$) of the rollers so that a consistent pressure distribution on the roller surfaces to be cleaned is ensured, the longitudinal direction (L) of the guide runs at a distance (a) to a plane (E) in which lie the two axes of the rollers that are arranged at a radial distance (b) from one another.

7 Claims, 2 Drawing Sheets

CLEARER ROLLER HOLDER FOR A TEXTILE MACHINE

FIELD OF THE INVENTION

The invention relates to a device for cleaning roller surfaces of rollers that are arranged one behind the other at a radial distance from one another for processing fiber material on a textile machine. A clearer roller is received in a guide of a clearer roller holder, wherein the guide is acted on by a spring element and the clearer roller is pressed via a pressing force against the roller surface of the adjacent rollers.

BACKGROUND

A device of this kind is described, e.g., in U.S. Pat. No. 2,730,770. Here, the device is implemented as a multi-cylinder drafting arrangement for drafting fiber material. The multi-cylinder drafting arrangement comprises three roller pairs that are arranged one behind the other and form a pre-drafting zone and a main draft zone. In the main draft zone, a bottom apron and a top apron are arranged for guiding the fiber material, wherein the bottom apron and the top apron each revolve around the bottom roller and the top roller, respectively, of the middle roller pair.

For cleaning the surface of the bottom infeed roller and the bottom apron, a clearer roller is arranged in the drafting arrangement between the bottom infeed roller and the bottom roller of the middle roller pair around which the bottom apron revolves. The clearer roller is mounted via two bent spring elements. At the one end, the spring elements are fixedly connected to the frame of the drafting arrangement, and at their other end, they have a U-shaped holder via which the journals of the clearer roller are received. The holders are configured such that the clearer roller journals in the holder can be moved transverse to the clearer roller axis. By means of the spring elements, on the one hand, the clearer roller is brought in contact with the surface of the bottom infeed roller and the bottom apron. On the other hand, the clearer roller is subjected via the spring elements to a pressing force against the surface of the bottom infeed roller, whereby an intensified cleaning efficiency on the surface of the bottom infeed roller is achieved.

In order to ensure a continuously high yarn quality, some of the rollers of the device have to be reground after a certain running time. It is possible here that, depending on the degree of wear, the rollers are reground to a different extent, and as a result, the initial diameter ratio between the rollers changes. In order for the clearer roller to be subjected to a consistent pressing force against the roller surface to be cleaned, the clearer roller thus has to be able to adapt to different diameter ratios of the rollers.

In the device illustrated in U.S. Pat. No. 2,730,770, the bottom infeed roller does not have to be reground due to its metallic surface so that the diameter ratio between the roller does not change during operation. However, the top infeed roller having a rubber coating on its surface has to be reground regularly so as to ensure a continuously high yarn quality. If the clearer roller for cleaning the top infeed roller and the top apron would be arranged between the top infeed roller and the top apron, it therefore would be necessary to adapt the position of the clearer roller to different diameter ratios so as to ensure a consistent cleaning efficiency on the surface of the top infeed roller and the top apron. However, this would not be possible due to the alignment of the spring elements in the drafting arrangement. If the top infeed roller of the drafting arrangement would be reground, the clearer roller would be pressed by the spring elements against the surface of the top infeed roller. Thus, consistent cleaning efficiency of the surface of the top infeed would be ensured. However, due to the diameter reduction of the top infeed roller, the position of the clearer roller would shift towards the top infeed roller. Through this, the distance of the clearer roller from the top apron would increase, which would result in that the cleaning efficiency on the top apron decreases, and a consistent cleaning efficiency of the top apron would no longer be ensured.

Another device of this kind is described in DE 1 833 936 U. Therein, a clearer roller is shown which is provided for cleaning roller surfaces of rollers arranged next to one another at a radial distance. Here, a bent spring element is secured on a top roller support arm of a twin drafting arrangement. The spring element rests against the clearer roller journals of the clearer roller and exerts via that journals a compression force on the clearer roller. The clearer roller therefore is subjected by the spring element to an additional pressing force against the roller surfaces to be cleaned, whereby intensified cleaning efficiency of the clearer roller on the roller surfaces to be cleaned is achieved.

The disadvantage of this embodiment is that by swiveling the top roller support arm upwards, it is not ensured that the clearer roller is lifted off the roller surface to be cleaned since the spring element only loosely rests against the clearer roller journal. This poses the danger that the clearer roller falls out of the device when swiveling the top roller support arm upwards. Thus, prior to swiveling the top roller support arm upwards, the clearer roller has to be removed from the device. In order to nevertheless enable lifting off the clearer roller by means of the top roller support arm, DE 1 833 936 U proposes an embodiment of the spring element in which the clearer roller journals are enclosed by the spring element so that when swiveling the top roller support arm upwards, the clearer roller is swiveled upwards at the same time. However, the solution described in DE 1 833 936 U, which enables lifting off the clearer roller from the roller surfaces to be cleaned, does not contain any indication that in the case of regrinding a roller, the clearer roller is able to adapt to the changed diameter ratios of the rollers so that this device also cannot ensure consistent pressure distribution on the roller surfaces to be cleaned.

SUMMARY OF THE INVENTION

It is therefore an object of the invention to design a device for processing fiber material in such a manner that by swiveling a top roller support upwards, a clearer roller is lifted off the roller surfaces to be cleaned and is able to adapt to different diameter ratios in such a manner that a consistent pressure distribution on the roller surfaces to be cleaned is ensured. Additional objects and advantages of the invention will be set forth in part in the following description, or may be obvious from the description, or may be learned through practice of the invention.

Within the context of the present invention, fiber material is to be understood as an elongated formation of individual fibers, the length of which is significantly shorter than the length of the formation. The fiber material can be a drafted sliver which is processed, for example, on a roving frame so as to form a roving provided with a protective twist. Likewise, the fiber material can be a drafted roving which is processed on a spinning machine, for example a ring spinning machine, so as to form a finish-twisted yarn.

The device according to the invention is suitable for spinning preparation machines such as roving frames, and also for spinning machines such as ring spinning machines, in particular if they have a multiplicity of working stations on which in each case a roving or a yarn is produced. It is also conceivable here that fiber material in the form of a plurality of slivers is fed to a working station, which slivers are processed together in the device.

The objects are achieved according to the invention in that the clearer roller holder is arranged in the device in such a manner that the longitudinal direction of the guide of the clearer roller holder runs at a distance from a plane in which lie the two axes of the rollers arranged at a radial distance from one another. The longitudinal direction is that direction in which the clearer roller can freely move in the guide of the clearer roller holder. Through this, it is achieved that the clearer roller engages under the action of a pressing force on the roller surface to be cleaned and also is able to adapt via the guide to different diameter ratios in such a manner that a consistent pressing force of the clearer roller against the roller surface to be cleaned is ensured.

Furthermore, it is advantageous if the guide of the clearer roller holder is fork-shaped. Fork-shaped is to be understood here such that the guide has an opening on one side for inserting the clearer roller, and two guide surfaces that are spaced apart from one another. Through this, there is the possibility that the clearer roller is able by itself to optimally adapt to different diameter ratios of the rollers, that is, is able to move precisely into that position in which it is subjected to the optimum pressing force against the roller surfaces to be cleaned.

Likewise, it is advantageous if one of the two guide surfaces of the clearer roller holder is elastically deflectable. In this way, the clearer roller can be attached to the clearer roller holder in a simple and fast manner, or can be moved away from the clearer roller holder by temporarily changing the distance between the two guide surfaces by applying an external force.

Moreover, it is of advantage if at the opening of the guide, the distance between the guide surfaces is smaller than the diameter of the clearer roller axle. Through this it is prevented that the clearer roller can disengage by itself from the guide. In order to replace a clearer roller, the opening of the guide thus has to be widened to the diameter of the clearer roller axle by applying an external force. Furthermore, it has proved advantageous if the clearer roller holder is made from a plastic material that has good elastic spring properties. In this manner, the clearer roller is subjected to an optimum pressing force against the roller surfaces so that optimum cleaning efficiency on the roller surfaces is achieved.

Likewise, it is of advantage if the clearer roller holder is fastened via a fastening element on a holding bracket, wherein the holding bracket is attached to a top roller support arm. Through this there is the possibility to use the clearer roller holder on different devices.

Finally, it is advantageous if the fastening element is mounted on the holding bracket in a movable manner. In this way, the clearer roller holder can be positioned in the device in such a manner that the clearer roller rests optimally against the roller surfaces to be cleaned, and optimum cleaning efficiency on the roller surfaces is achieved.

The invention is illustrated and described in greater detail below by means of an exemplary embodiment. In the figures:

DETAILED DESCRIPTION

Figure 1:
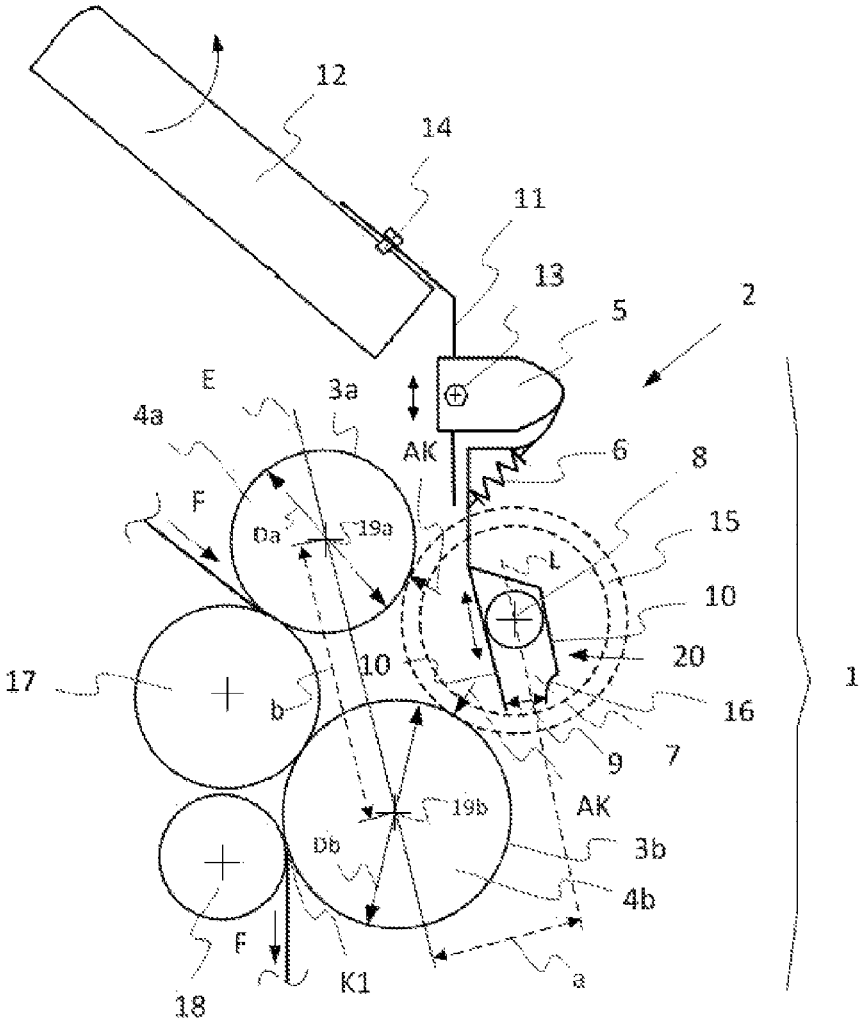
FIG. 1 shows a side view of a device according to the invention with a clearer roller holder.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a side view of a device 1 according to the invention for processing a fiber material F. The device 1 comprises the rollers 4*a*, 4*b*, which are friction-driven by a roller 17 that is connected to a drive, which is not shown here. In the present example, the roller 17 is a delivery roller of a drafting arrangement on which a pressure roller 4*a* rests. On its circumferential surface 3*a*, the pressure roller 4*a* has a rubber coating, for example. Subsequent to the delivery roller 17, a compacting roller 4*b* is arranged which, e.g., is friction-driven by the delivery roller 17. Usually, the compacting roller 4*b* has a metallic surface 3*b* on which compacting the fiber material delivered from the drafting arrangement takes place. The compacted fiber material F is then transferred via a clamping station K1 to a twist generation means, which is not shown here. The clamping station K1 is formed by a twist stop roller 18, which rests on the circumferential surface 3*b* of the compacting roller 4*b*.

Furthermore, the device comprises a clearer roller holder 2, via which two clearer rollers 15 (FIG. 2) are mounted for cleaning the roller surfaces 3*a*, 3*b* of the rollers 4*a*, 4*b*, which are arranged one below the other at a radial distance from one another. The clearer roller holder 2 is composed of a fastening element 5 and a receiving element 20, wherein a spring element 6 is arranged between the fastening element 5 and the receiving element 20. Via the spring element 6, the receiving element 20 is subjected to a reset force during deflection. The clearer roller holder 2 is adjustably mounted via the fastening element 5 with a screw 13 on the holding bracket 11, wherein the holding bracket 11 is detachably fitted via a screw connection 14 on a swivelable top roller support arm 12 of a twin drafting arrangement of a spinning machine.

Figure 2:
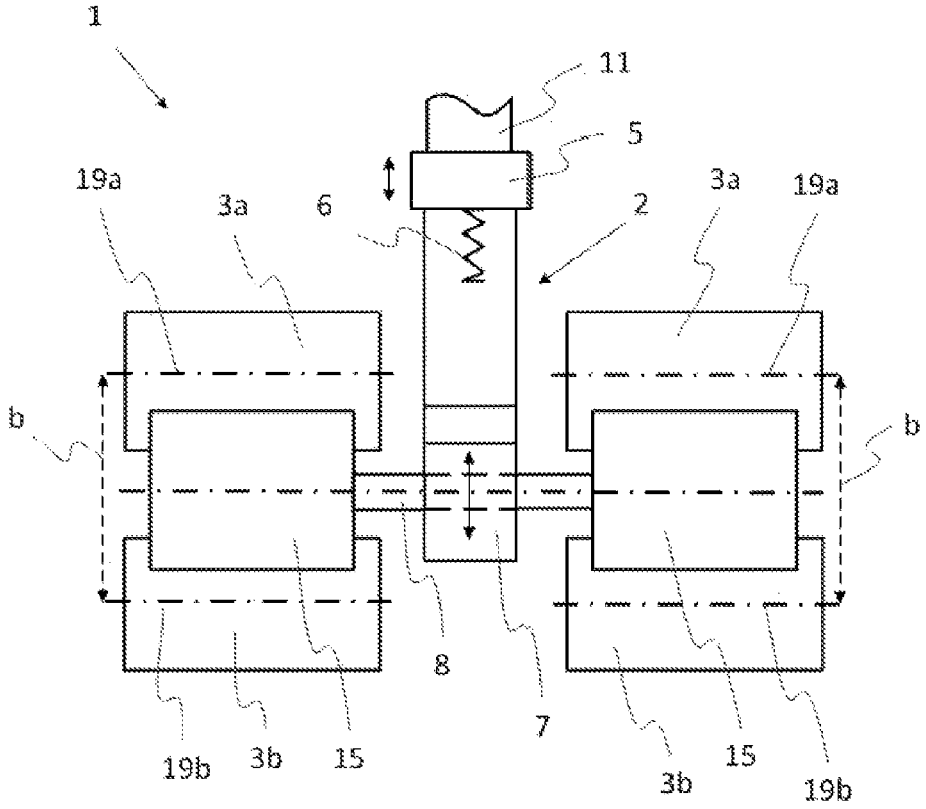
FIG. 2 shows a partial front view of the device according to FIG. 1.

The receiving element 20 serves for mounting a clearer roller axle 8, at both ends of which in each case a clearer roller 15 is mounted in a rotatable manner (FIG. 2). Also possible is an embodiment in which the clearer rollers 15 are fixedly connected to the clearer roller axle 8, and the clearer roller axle 8 is rotatably mounted in the receiving element 20. The clearer rollers 15 rest against the roller surfaces 3*a*, 3*b* to be cleaned of the two rollers 4*a*, 4*b*, which are arranged one below the other at a radial distance from one another.

The compacting roller 4*b* provided with a metallic circumferential surface 3*b* does not need to be reground. However, the rubber coating of the roller 4*a* is subjected to wear so that for maintaining quality, the roller has to be reground regularly. Because of this, the diameter ratio $D_b/D_a$ of the two rollers 4*a*, 4*b* which are arranged one below the other at a radial distance changes constantly. In order to ensure consistent cleaning efficiency on both roller surfaces 3*a*, 3*b*, it is therefore necessary to adapt the position of the clearer roller 15 and the loading direction thereof to different diameter ratios $D_b/D_a$.

In the position shown, the receiving element 20 is deflected and transmits the reset force applied by the spring element 6 onto the receiving element 20 to the clearer rollers 15. Through this, the clearer rollers 15 are pressed under the action of a pressing force AK against the roller surfaces 3*a*, 3*b* to be cleaned. In order for the clearer rollers 15 to be able to adapt to different diameter ratios $D_b/D_a$ of the rollers 4*a*, 4*b*, the receiving element 20 has a guide 7 that is implemented in such a manner that the longitudinal direction L of the guide 7 runs at a distance a from a plane E in which lie the two axes 19*a*, 19*b* of the rollers 4*a*, 4*b* which are arranged at a radial distance b from one another. Here, the longitudinal direction L represents that direction in which the clearer roller axle 8 can freely move in the guide 7 of the clearer roller holder 2. This ensures that the clearer roller 15 can adapt by itself to different diameter ratios $D_b/D_a$ of the rollers 4*a*, 4*b* and thereby are subjected to a consistent pressing force AK acting on the roller surfaces 3*a*, 3*b* to be cleaned.

The guide 7 has an opening 9 on one side for inserting the clearer roller axle 8, and two guide surfaces 10 that are spaced apart from one another. The distance between the guide surfaces 10 is selected such that the clearer roller axle 8 can move in the guide 7 and can take up precisely that position in the guide 7 in which the clearer rollers 15 are subjected to an optimum pressing force AK against the roller surfaces 3*a*, 3*b* to be cleaned. For securing the clearer roller axle 8 in the guide 7, one of the guide surfaces 10 has a constriction 16 at the opening 9, as a result of which the distance between the guide surfaces 10 at the opening 9 is smaller than the diameter of the clearer roller axle 8. Through this, it is prevented that the clearer roller axle 8 can disengage by itself from the guide 7 when swiveling the top roller support arm 12 upwards. When replacing the clearer rollers 15, the opening 9 therefore has to be temporarily widened to the diameter of the clearer roller axle 8 by applying external force. For this, one of the two guide surfaces 10 is elastically deflectable. The clearer roller holder 2 is preferably made from a plastic material that has good elastic spring properties.

Modifications and variations can be made to the embodiments illustrated or described herein without departing from the scope and spirit of the invention as set forth in the appended claims.

The invention claimed is:

1. A device for cleaning roller surfaces of rollers arranged one behind the other and offset at a radial distance from each other in a textile machine, comprising:

a clearer roller received in a guide of a clearer roller holder;

a spring element disposed so as to exert a pressing force of the guide so that the clearer roller is pressed against the roller surfaces of the rollers to be cleaned;

the guide comprising a longitudinal axis direction along which the clearer roller is movable relative to the guide, the longitudinal direction radially offset from and parallel to a plane running through a rotational axis of each of the rollers to be cleaned such that the clearer roller remains pressed against the roller surfaces as the clearer roller moves along the longitudinal direction of the guide.

2. The device as in claim 1, wherein the guide comprises opposite guide surfaces defining the longitudinal direction of the guide, the guide surfaces defining an opening at an end thereof for receipt of an axle of the clearer roller between the guide surfaces.

3. The device as in claim 2, wherein at least one of the guide surfaces is elastically deflectable so as to change a distance between the guide surfaces.

4. The device as in claim 2, wherein the opening has a distance between the guide surfaces that is smaller than the diameter of the clearer roller axle.

5. The device as in claim 1, wherein the clearer roller holder is made of a plastic material.

6. The device as in claim 1, further comprising a bracket attached to a top roller support arm in a textile machine in which the device is installed, the clearer roller holder fastened to the bracket with a fastening element.

7. The device as in claim 6, wherein the fastening element is movable along the bracket for changing the position of the clearer roller holder on the bracket.

* * * * *